United States Patent [19]

Harding

[11] Patent Number: 4,637,299

[45] Date of Patent: Jan. 20, 1987

[54] VENT OPENING FOR PORTABLE BUILDING WALL

[75] Inventor: George W. Harding, Clearwater, Fla.

[73] Assignee: Poly-John Enterprises Corp., Whiting, Ind.

[21] Appl. No.: 809,307

[22] Filed: Dec. 16, 1985

[51] Int. Cl.[4] ..... F24F 7/00

[52] U.S. Cl. ..... 98/29; 4/460; 98/88.1

[58] Field of Search ..... 98/29, 32, 37, 42.01, 98/88.1, 99.8; 49/463; 160/105, 369; 425/308; 4/209 R, 218, 219, 460, 461

[56] References Cited

U.S. PATENT DOCUMENTS

| | | | |
|---|---|---|---|
| 913,449 | 2/1909 | Ashcroft | 98/37 |
| 2,723,732 | 11/1955 | Pettersen | 49/463 X |
| 4,274,330 | 6/1981 | Witten et al. | 98/29 X |
| 4,550,648 | 11/1985 | Eagle | 98/37 |

*Primary Examiner*—Harold Joyce

*Attorney, Agent, or Firm*—Cullen, Sloman, Cantor, Grauer, Scott and Rutherford

[57] ABSTRACT

A vent opening for a portable building wall forming panel made of a thin, plastic sheet is formed by a series of aligned, roughly rectangular shaped, box-like depressions in the sheet to provide a series of depressed longitudinal and end walls which are integral with the panel and the respective bases of the depressions. A series of aligned openings are formed by cutting away the depression end walls and the bases, except for narrow base portion strips at the longitudinal walls. This provides longitudinal flanges that are integral with the panel and with their free edges terminating in integral flange strips which are substantially in the same plane. The junctures of the longitudinal walls with their adjacent panel portions, which define the openings, form an acute angle. The junctions between the free edges of the longitudinal walls and their flange edge strips also form an acute angle and consequently, provide opposing channels in each opening, with the channels being longitudinally aligned along the series of openings. A stiff, foraminous sheet is slid endwise between the opposed flanges and the sheet edges are held within the channels and against the strips formed of the panel portions located between adjacent openings.

4 Claims, 7 Drawing Figures

VENT OPENING FOR PORTABLE BUILDING WALL

BACKGROUND OF INVENTION

Portable buildings or cabanas which are typically used for portable chemical toilets are usually provided with vent or window openings in their wall panels or door panels. Such vent openings are typically formed by cutting a suitable size opening within the panel, framing the opening and covering it with a screen material. Examples of this type of construction are shown in my prior U.S. Pat. No. 3,447,167 issued June 3, 1969 which illustrates such vent openings formed near the bottoms of the cabana panels and the door panel. Another example is my U.S. Pat. No. 4,446,585 issued May 8, 1984 and illustrating vent openings formed near the upper portions of the cabana wall panels. Another similar example of such a vent is shown in U.S. Pat. No. 4,065,885 issued Jan. 3, 1978.

Such conventional vent openings are relatively expensive and somewhat difficult to maintain as they can be easily damaged. Also, then can corrode if the framing is made of metal. Further, they are relatively difficult to repair in the event of damage. Moreover, since the portable building or cabana structures are typically formed of thin wall plastic panels, it is difficult to install a framed vent opening or window which will not become loose or broken free of the plastic panel over a long period of use.

Consequently, the invention herein relates to vent openings that are similar to screened window openings, formed integrally in the plastic sheet panels of portable buildings which are especially useful for portable chemical toilets.

SUMMARY OF INVENTION

The invention herein contemplates a vent opening construction and a method of making such construction in a large, thin wall, plastic panel which forms a wall or a door of a portable building structure. The openings are made by molding roughly rectangular shaped depressions in the plastic panel to form a series of aligned, box-like depressions having flat bases joined by walls to the main body of the panel. The walls define opposite longitudinal walls which are aligned along the series of depressions and transverse or end walls.

The longitudinal walls are angled to form acute angled junctions with the main panel body and also with the depression bases. Thus, each opposing pair of longitudinal walls angle away from each other from the main panel body.

After the depressions are formed in the panels, the bases of the depressions and the end walls are cut away, leaving the longitudinal walls and narrow strips of the bases integral with the free edges of the longitudinal walls. In cross-section, the longitudinal walls, their free edge strips and adjacent portions of the panel give a generally Z-shaped appearance. The corners formed by the junctures of the longitudinal walls and their free edge strips provide longitudinal channels, opening towards each other, in each opening. These channels are aligned end to end along the series of openings.

The vent openings are covered by merely sliding endwise a relatively stiff sheet of a foraminous material, such as expanded metal or wire woven screen, or a semi-rigid plastic screen, through the aligned longitudinal channels which frictionally hold the sheet edges.

Mechanical fastening means may further be used to prevent removal of the screen.

This invention contemplates using the inherent resiliency of the relatively stiff, but somewhat resilient, plastic material that is commonly used for forming wall panels, door panels and the like for portable building structures in the process of forming the angled longitudinal walls. That is, if the walls are vacuum formed within a mold, the longitudinal walls must be pulled into an undercut wall section of the depression cavity where ordinarily they could not be removed after molding. However, due to the inherent resiliency of the material, the panel can be pulled out of the undercut mold cavity. The angled walls will momentarily, resiliently, deflect during removal and then they will return to their molded shape.

An object of the foregoing method and resulting vent opening structure is to form a frameless, integral, window or vent opening which is part of the wall panel. The only movable part for the window is the screen which, if damaged, can be easily pushed or slid out and replaced.

A further object is to form a window or vent opening which is inexpensive to make, and requires almost no additional parts, i.e., only the screen and mechanical fasteners, such as rivets.

Yet a further object is to provide a method or system for easily and quickly molding window or vent openings at almost any preselected place in the portable building construction, that is, near the top or near the bottom or in the door, etc., without much additional labor or equipment expense and which produces a durable window construction.

These and other objects and advantages of this invention will become apparent upon reading the following description, of which the attached drawings form a part.

DETAILED DESCRIPTION

Figure 1:
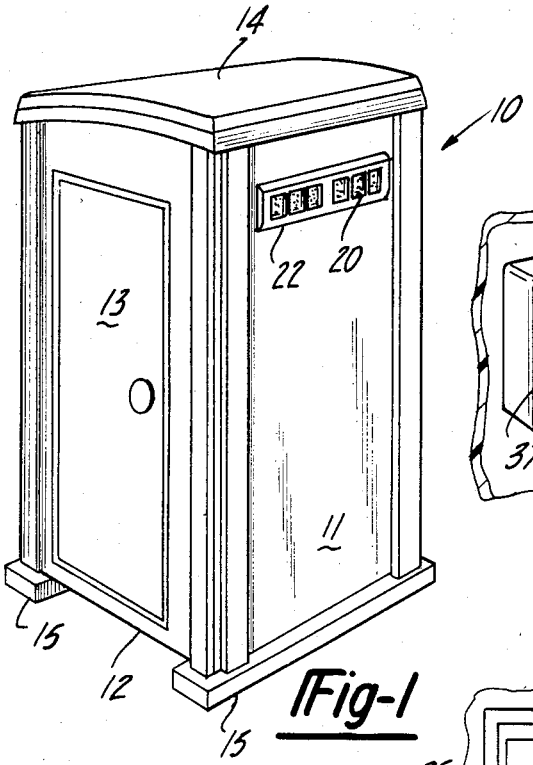
FIG. 1 is a perspective view of a portable building or cabana.

FIG. 1 illustrates a portable chemical toilet cabana or building structure, such as that disclosed in my U.S. application Ser. No. 06/666,560 filed Oct. 30, 1984. The cabana 10 is made of side and rear walls 11, and a front wall 12 having a door 13. A curved roof panel 14 is fastened to the upper ends of the walls by suitable fastening means.

The portable building or cabana is mounted upon wood support or base strips 15 which support the structure and also enable it to be easily moved. Such wood supports are typically fastened by screws or the like to the lower edges of the building walls.

The building walls are made of thin panels of a plastic material which is relatively stiff, but somewhat resilient. For example, polyethylene plastic or the like commercially available plastics may be used. The selection of the particular plastic depends upon availability, strength requirements, cost and the like.

Figure 2:
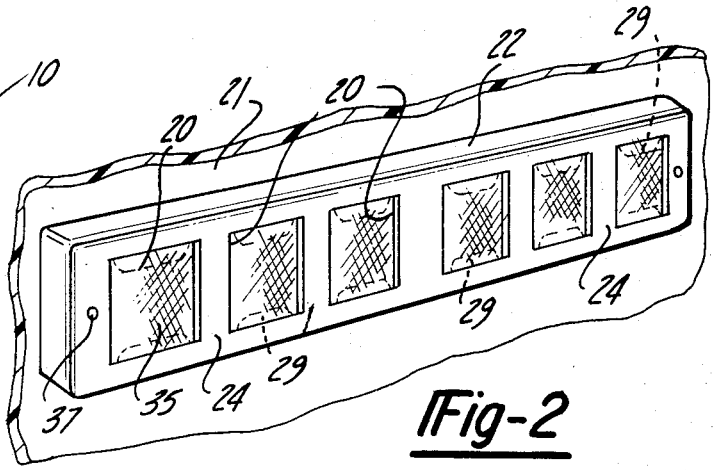
FIG. 2 is an enlarged, fragmentary, perspective view of a portion of the wall panel containing the vent openings.

As shown in FIG. 2, vent or window openings 20 are formed in one or more of the plastic panels 21. Although the openings are shown as formed in the wall panels, they also can be formed in the door panels in the same manner. Thus, references to wall panels, includes door panels. The plastic panel 21 is provided with an integrally formed frame-like embossment 22 shaped like an enlarged, elongated, baking pan. The outer surface 23 of the embossment forms the outer panel for the window openings. The embossment may be eliminated entirely and thus, the outer surface 23 would be the area of the unembossed plastic panel which surrounds the window openings.

As illustrated, the openings are preferably formed in an aligned series, spaced closely together, such as in two groups of three each. The openings are separated by transverse, narrow strips 24 formed of the panel portions located between the openings.

Figure 5:
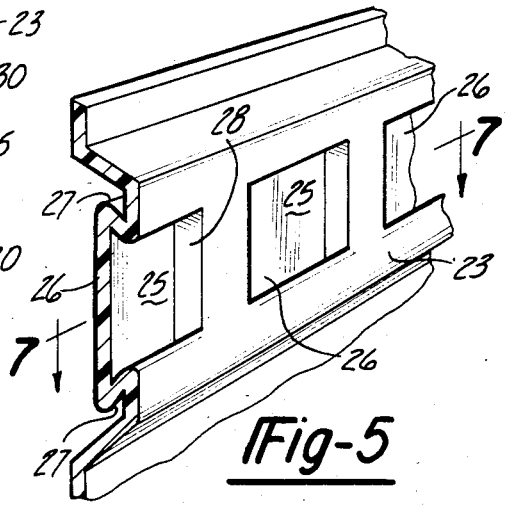
FIG. 5 is a perspective, fragmentary, cross-sectional view of the panel and the depressions formed therein.
Figure 7:
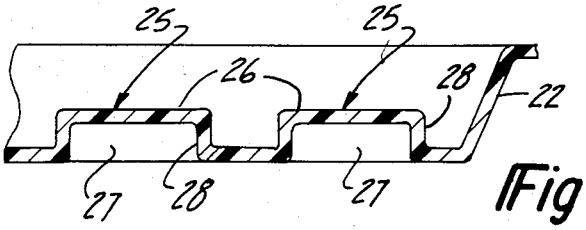
FIG. 7 is an enlarged, cross-sectional, fragmentary view, of the panels with the depressions, taken as if in the direction of arrows 7—7 of FIG. 5.

At the outset, when the plastic panels are made, they normally would be vacuum formed in a cavity mold to mold the window frame embossments where desired. Simultaneously, the rectangular, box-like depressions 25 are molded. Each depression has a flat base 26, integral longitudinal upper and lower walls 27, and transverse, end walls 28. FIG. 5 illustrates the depressions and FIG. 7 shows, in cross-section, the depression bases and the end walls 28.

Figure 6:
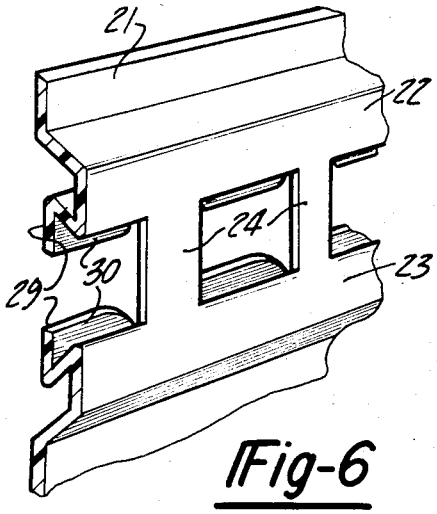
FIG. 6 is a fragmentary, perspective view similar to FIG. 5, but showing the vent openings formed by cutting away portions of the depressions.

The window openings are formed by cutting away, with a suitable cutting tool, the end walls and a substantial portion of the base of each of the depressions. The portions of the base adjacent to the free ends of the longitudinal walls are left intact to provide strips 29 (see FIG. 6).

The longitudinal upper and lower walls are arranged at an acute angle relative to the surface 23. In addition, they are at an acute angle relative to the strips 29 which were formed by cutting away the major portions of the depression bases. This results in a generally Z-shaped cross-section made up of the longitudinal wall, its free edge strip 29 and the adjacent portion of the surface 23. That configuration provides longitudinal channels 30 which open towards each other in each opening 20.

The longitudinal channels of the series of openings are aligned, end to end on the inner face of the panel. That alignment provides a track within which a stiff, foraminous sheet 35 may be endwise slid.

Figure 3:
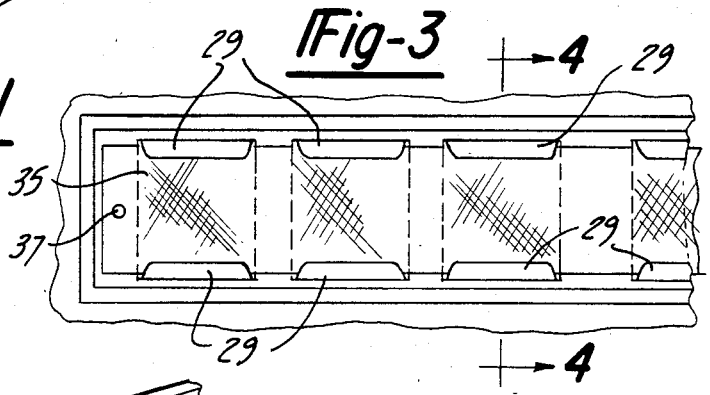
FIG. 3 is an enlarged, fragmentary, elevational rear view of a portion of the vent openings.
Figure 4:
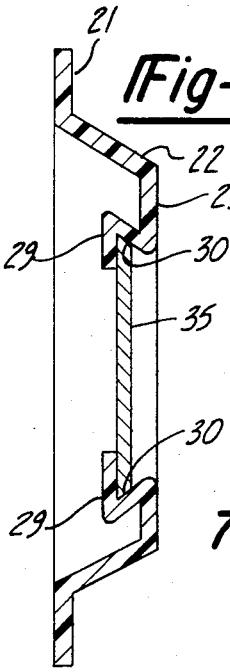
FIG. 4 is an enlarged, cross-sectional view, taken in the direction of arrows 4—4 of FIG. 3.

The sheet 35 may be made of expanded metal or wire woven screen material or a semi-rigid plastic screen or the like. Its longitudinal edges are slidably received within the opposing channels 30 which frictionally holds them after the sheet is slid into place, as illustrated in FIGS. 3 and 4. The opposite ends of the sheet may be secured by mechanical fasteners to the plastic panel. For example, conventional rivets 37 may be used for that purpose. Thus, the sheet cannot be removed without breaking or removing the fasteners.

Although it is preferred to use mechanical fasteners to hold the sheet in place on the panel, for some purposes, one or both of the opposite, transverse end walls of the most remote openings can be formed in the same way as the longitudinal walls to provide a channel to receive the adjacent free end of the sheet. In that way, the end of the sheet is received within such a channel and the mechanical fastener can be omitted. Otherwise, the end walls are all removed during the cutting away of the depression bases.

With this construction, in the event of damage to the screen, it may be removed and replaced by breaking or otherwise removing the fastener 37 and then pulling the screen out of the longitudinal channels. A replacement may be inserted in the same way as the original. Otherwise, there are no other parts or frames which can be damaged or removed so that the structure is damage or vandal resistant.

Having fully described an operative embodiment of this invention, I now claim:

1. A vent for an enclosure wall panel formed of a thin, somewhat resilient, but relatively stiff sheet of plastic, comprising:

aligned, spaced apart vent openings formed in the panel, with the openings each having an opposed pair of straight, longitudinal edges that are endwise aligned with the corresponding longitudinal edges of the next opening, and with a panel strip portion defining the space between the openings;

flanges formed integral with each of the opening longitudinal edges and terminating in integral flange strips, which strips are parallel and extend towards each other from the respective ends of their opposed flanges;

the junctures of each of the flanges and the panel edge portions defining their respective openings forming an acute angle so that the opposed flanges of each opening angle away from each other, and the juncture of the flanges and their integral free edge strips form an acute angle, so that the opposed flanges and flange strips in each opening provide opposing longitudinal channels and the channels of each opening are longitudinally aligned with the corresponding channels of the next opening;

a relatively stiff, vent cover sheet covering the openings and having longitudinal edges arranged within and frictionally held within their adjacent flange channels;

and fastening means securing the opposite transverse ends of the cover sheets to the panel.

2. A vent as defined in claim 1, and including a series formed of a considerable number of said aligned, spaced apart vent openings, each having aligned longitudinal flange channels;

and said cover sheet being endwise slidably insertable through said channels and havings its edges held by the aligned channels.

3. A vent as described in claim 1, and said cover sheet being formed of a foraminous metal sheet, such as expanded metal sheet, woven wire sheet, plastic sheets and the like.

4. A vent as defined in claim 2, and said fastening means comprising rivets inserted through the cover sheet and adjacent panel portion, so that the cover sheet can be removed, if necessary, by first removing the rivets.

* * * * *